United States Patent [19]

Ramond

[11] Patent Number: 4,469,029

[45] Date of Patent: Sep. 4, 1984

[54] UNIVERSAL WORK STATION, WHICH CAN BE TRANSFORMED AND ADAPTED, ALLOWING MULTIPLE AND PRACTICAL SPECIFIC USES

[76] Inventor: Marcel Ramond, 159bis quai de Valmy, 75010 Paris, France

[21] Appl. No.: 342,495

[22] Filed: Jan. 25, 1982

[30] Foreign Application Priority Data

Jan. 27, 1981 [FR] France ..... 81 01913
Dec. 8, 1981 [FR] France ..... 81 23323

[51] Int. Cl.[3] ..... A47F 5/12

[52] U.S. Cl. ..... 108/3; 108/99; 297/124

[58] Field of Search ..... 108/147, 92, 99, 72, 108/76, 3, 5; 297/124, 125, 122; 248/240, 240.4, 242

[56] References Cited

U.S. PATENT DOCUMENTS 1,292,470 1/1919 Hubschmitt ..... 108/147
1,725,329 8/1929 Blandford ..... 108/147
2,698,647 1/1955 Costanzo ..... 108/99
2,724,923 11/1955 Weir ..... 108/3
3,385,238 5/1968 Jay ..... 108/147

FOREIGN PATENT DOCUMENTS 204257 11/1908 Fed. Rep. of Germany ..... 108/3
43099 10/1970 Finland ..... 297/124
245627 8/1947 Switzerland ..... 108/3

*Primary Examiner*—William E. Lyddane
*Assistant Examiner*—Mark W. Binder
*Attorney, Agent, or Firm*—Eric P. Schellin

[57] ABSTRACT

This work station is comprised of support legs (P) with a stable support base (1*a*) and uprights (1*b*) on which pivoting elbows are adapted to form adjacent arms (2*a*–2*b*) which are positioned and locked in place in an adjustable angular manner at one end of these arms, the other end bearing supports or work tops (3 and 4) positioned and locked in place in a manner which can be angularly adjusted at will, so that these supports or work tops (3–4) allow effects and uses which are multiple and can be combined together.

13 Claims, 15 Drawing Figures

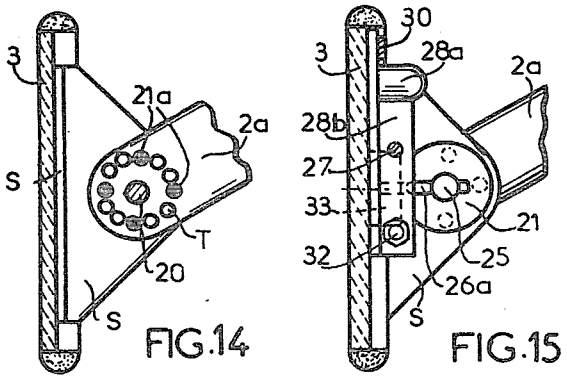
FIG.15
FIG.14
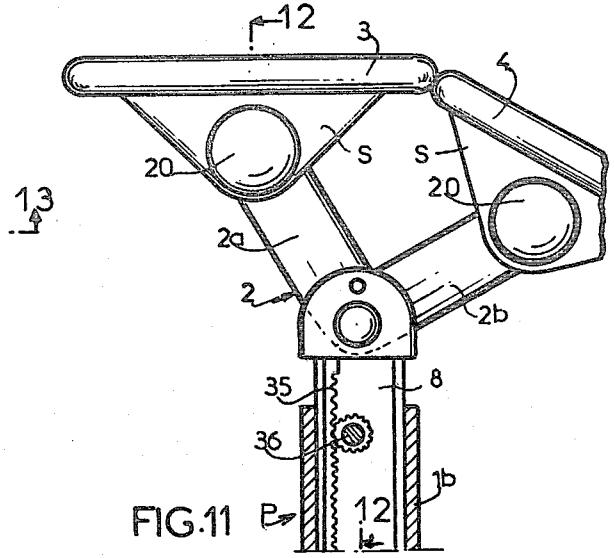
FIG.11
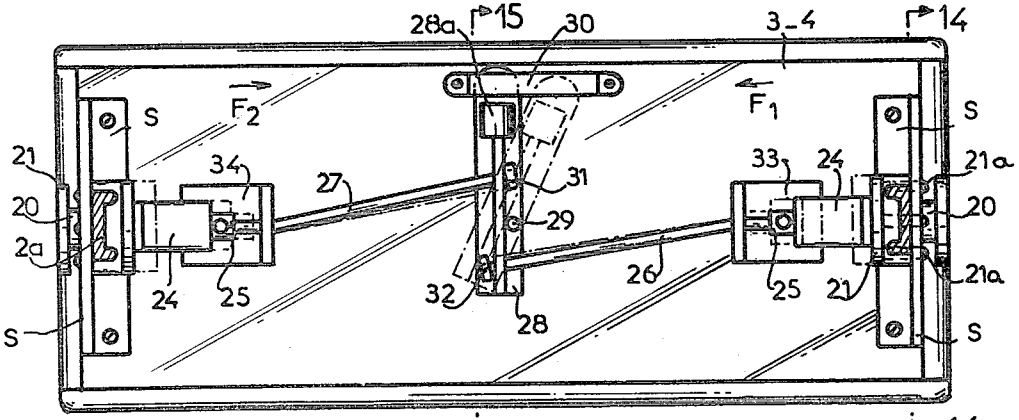
FIG.13
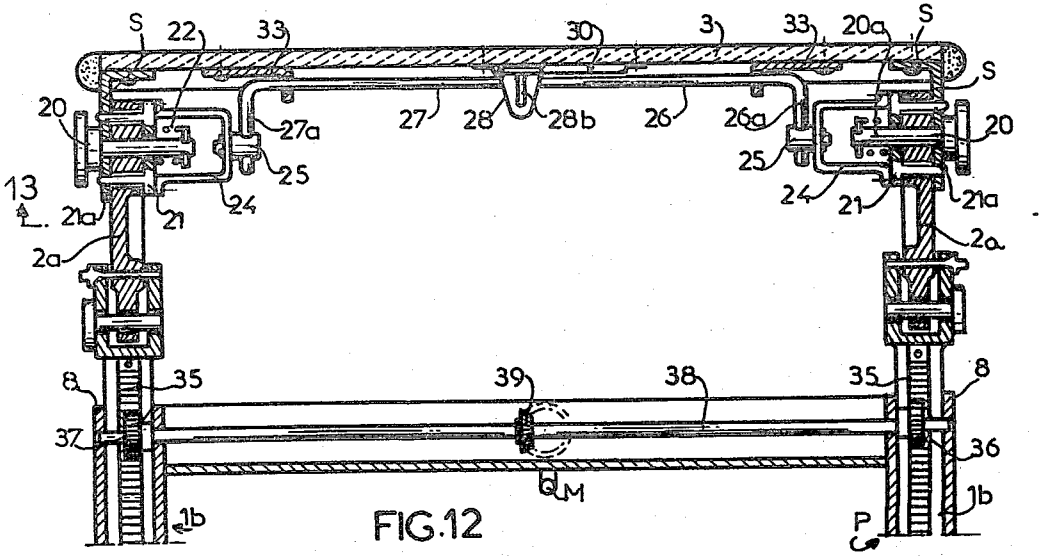
FIG.12

UNIVERSAL WORK STATION, WHICH CAN BE TRANSFORMED AND ADAPTED, ALLOWING MULTIPLE AND PRACTICAL SPECIFIC USES

The invention concerns an all-purpose work station which can be transformed and adapted, allowing multiple and practical specific uses.

The work station, understood in a very wide capacity covering not only the field of office work, but also design and engineering offices, workshops, the most varied services, including the table for domestic purposes considered as a work surface or a work station, a school desk, etc . . . should take new requirements and new demands into consideration.

It must be possible to work at heights, in positions, according to the volumes, which are variable and adjustable. We aim especially to fulfill the following requirements: varied and flexible use, great mobility, adaptation to the users and the working conditions.

The work station as per the invention has been designed to have a universal character in this objective, in view of these results. In firms, in everyday life: domestic apparatus, school and university equipment . . . one has to have different activities and use, for the same work or else for numerous pieces of work, very different equipment, one after another: typewriters, computers, data processing equipment.

To describe the subject of the invention, without limiting it however, to the diagrams of the drawings enclosed:

FIG. 11 is a partial view in profile and in cross section of the work station, showing one alternative variation.

FIG. 12 is a longitudinal cross section view, following line 12—12 on FIG. 11.

FIG. 13 is a cross section view, following the line 13—13 on FIG. 12.

FIG. 14 is a transversal cross section view, following the line 14—14 on FIG. 13.

FIG. 15 is a transversal cross section view, following the line 15—15 on FIG. 13.

According to the invention and in the examples which are in no way restrictive illustrated on the drawings, this universal work station, which can be transformed and adapted, is essentially comprised of: supporting legs P with support base 1*a* and uprights 1*b* on which can be fitted directly or in a built-up way, pivoting elbows, 2, whose angle can be adjusted, with arms 2*a* and 2*b* whose free ends respectively bear the supports or work tops 3 and 4 whose tilting angle can be adjusted and locked in position depending on the uses.

Figure 1:
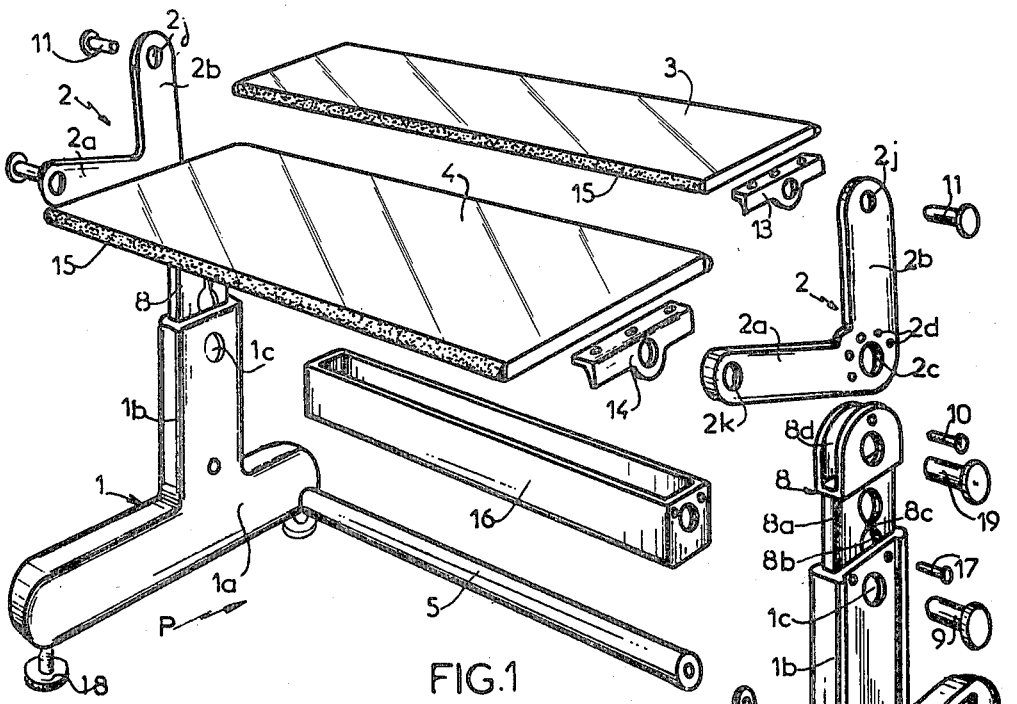
FIG. 1 shows, by a view in perspective, the work station before mounting of the various elements of its structure.
Figure 2:
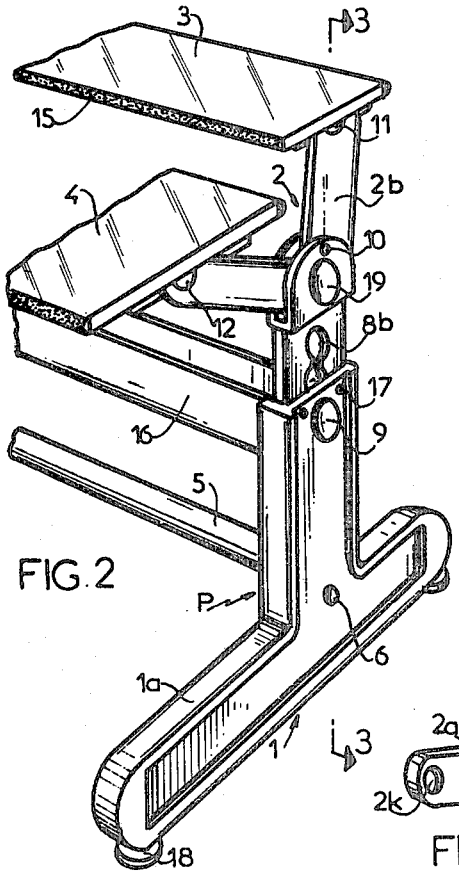
FIG. 2 is a partial view of the work station according to FIG. 1, after mounting of the elements of the structure.

On FIG. 1, the supporting legs P are comprised of two flanges facing each other, 1, in the shape of an upturned and unsymmetrical T, strongly connected at the bottom with a cross bar 5 which is mounted for example, with screws 6, and washers, 7.

It is preferable for the vertical uprights 1*b* of the supporting legs to be hollow and with a rectangular transverse cross section particularly to allow the adjustable supports, 8 to be assembled with easy sliding action, these supports having a rounded upper end to allow for the adjustable angular positioning of the elbows 2. The sliding part 8*a* of the supports 8 is provided with round openings, 8*b*, vertically and axially, which are separate or joined together, forming bottle necks 8*c*.

The openings 8*b* work respectively in conjunction with an opening 1*c* provided in the thick part of the top of the uprights 1*b* of the support legs P, while a locking screw 9 is inserted simultaneously in the opening 1*c* and in one or the other of the openings 8*b* to ensure the locking in place of the supporting elements 8, at the desired height.

The free end of the elements 8 forms a yoke, 8*d*, for the pivoting of the elbows 2.

As is illustrated in the version shown in FIG. 1, the arms 2*a* and 2*b* of the elbows 2, form a V-shaped rigid profile at an angle of about 90° and of equal length.

The angle formed by the adjacent arms 2*a* and 2*b* has a hole drilled at 2*c* to pivot in the yoke 8*d*, around an axle 19 held in position. Concentrically to the hole 2*c*, positioning holes, 2*d*, are drilled at intervals which may be regular or not to allow the free insertion of a peg, 10, which also passes through the flanges and the yoke 8*d*.

The elbows are thus locked circularly in an adjustable fashion according to the positioning of the peg 10 in one of the holes 2*d*. As a guide, the various positioning holes 2*d* are offset at angles of about 15 degrees.

Figure 4:
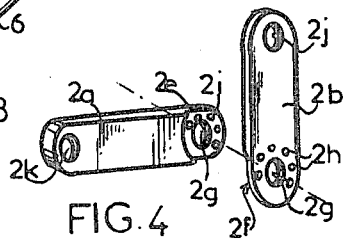
FIG. 4 is a view in perspective of an alternative variation of the coupling of the pivoting arms.

In the version shown in FIG. 4, the elbows also form a V-shaped profile, but with a variable opening. For this purpose, the arms 2*a* and 2*b* are independent and, according to their adjacent ends, form circular openings 2*e* and 2*f*, of a complementary shape so that they overlap and centre on each other when placed side by side. The openings 2*e* and 2*f* are drilled axially at 2*g* so that they can be pivoted in the yoke 8*d* around the axis 19. As described above, the positioning holes 2*h* and 2*i* are drilled concentrically to the axial hole 2*g* for the free insertion of the indexing peg 10 allowing in this case both the locking of the angle after adjusting the opening of the arms and also the angular position of each elbow.

The opposite ends of the arms 2*a* and 2*b* have holes at 2*j* and 2*k* for the free insertion of the pivoting axes 11 and 12 which operate respectively with one of the tops 3 and 4, in view of their possibility of being pivoted and locked in the angular position desired. The axes 11 and 12 are respectively inserted in the battens 13 and 14 fixed under the work tops 3 and 4 and slightly set back with regard to their surface on the edge.

Work tops 3 and 4 are made in widths I and II, preferably unequal widths which, taking into account the pivoting axle 11 and 12, allow the work tops 3 and 4 to be placed practically edge to edge in the same continuous plane; horizontally or tilted in order to form notably, a work table for industrial or domestic purposes.

It should be noted that the widest work top II is situated on the side of the largest support base 1*a* of the foot, to assure high stability.

The longitudinal edges of each of the work tops 3 and 4 are fitted with padding 15 in a soft material and with a rounded profile.

Provision is also made to link the upper parts of the two uprights 16 with a service duct which serves as a cross-bar. This duct in the shape of a channel is used for passing various accessories such as electric cables. It should also be noted that this service duct 16, attached to the uprights 1*b* by screws 17 or otherwise, may also be mounted in combination with the locking axle 19 of the support elements 8.

It should be noted that in the case when several work stations as described above are mounted side by side, provision is made for drilling axial holes in the locking axle 19 to ensure continuous passage between the various servie ducts 16 which are used for passing electric wires.

The supporting legs 1*a* may be equipped with jacks 18 which can be adjusted in height to line up to seating of the work stations units.

In a simplified version, the elbows are mounted pivoting and directly locked in the upper parts of the uprights 1*b* of the support legs, which thus forms a yoke.

In FIGS. 5 to 10 a few examples have been illustrated which are in no way restrictive concerning the uses of the work station, after transformation and adjustment of the angular positions of work tops 3 and 4 and/or the elbows 2.

Figure 5:
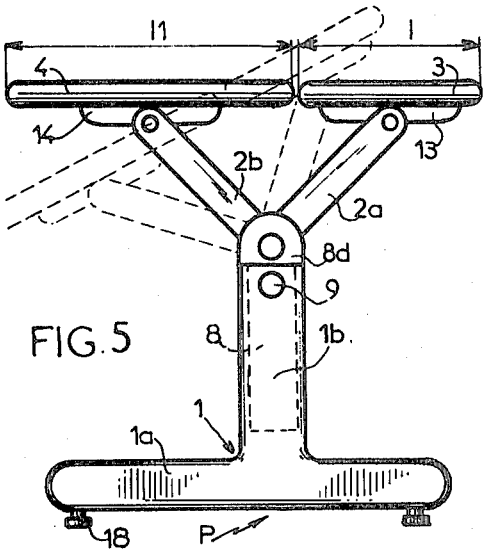
FIGS. 5 to 10 show, by views in profile, a few examples of different uses and possible transformations of the work station. On some drawings, in dotted lines we have illustrated accessories or other things which particularly apply to the transformation and use selected.

In FIG. 5, the two tops 3 and 4 have been placed edge to edge on the same continuous and horizontal plane to make one large table. This table may be tilted (as shown in dotted lines,) whilst the supports 8 are in the lowest possible position, in such a way that the aforementioned tops are at a height of approximately 75 cm with regard to the floor.

Figure 6:
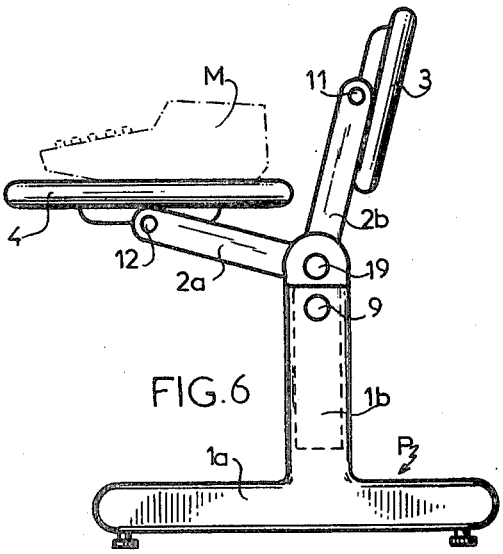

In FIG. 6, the large work top 4 is placed horizontally whereas the small work top 3 is tilted and reversed. The elbows are placed at an angle with regard to the support legs uprights so that the large work top 4 is situated at a height from the floor at about 65 cm, and the supports 8 are in the low position. In this position, the work station is particularly suitable for holding, by means of the large work top 4, a typewriter M (drawn in dotted lines), whereas the small work top is used as a desk for the documents which have to be typewritten.

Figure 7:
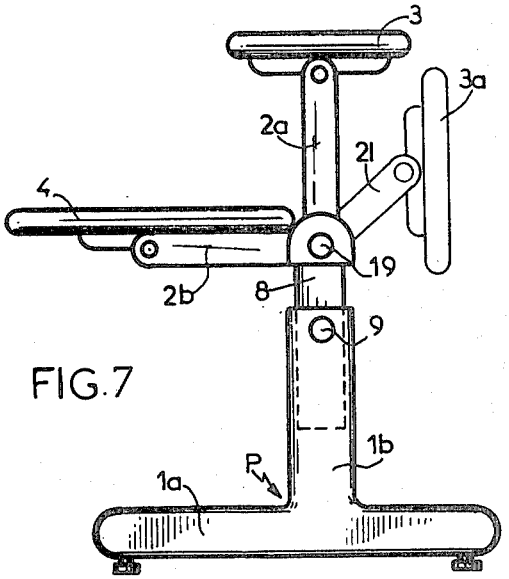

In FIG. 7, the two arms 2*a* and 2*b* of the elbows 2, are placed perpendicularly so that the arms 2*b* are in a horizontal position whereas the arms 2*a* are in a vertical position. The supports 8 can be adjusted vertically so that the large work top 4 (placed horizontally) is at a height of about 73 cm, for a standard operational position, whereas the small work top 3 is at a raised height of 1 m, to form a bench or support for a filing cabinet. The lower part may also receive a filing unit.

Figure 8:
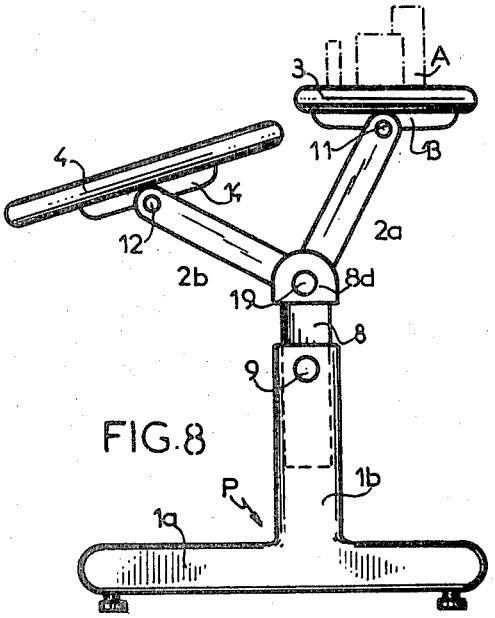

In FIG. 8, the large work top is at a height of 72 cm and is tilted about 20 degress. This position is particularly well adapted for any graphic or design work.

The small work top is placed at a height of about 90 cm and serves as a horizontal support and is close to hand for any tools to be used by the draughtsman. The support elements 8 are adjusted in height.

Figure 9:
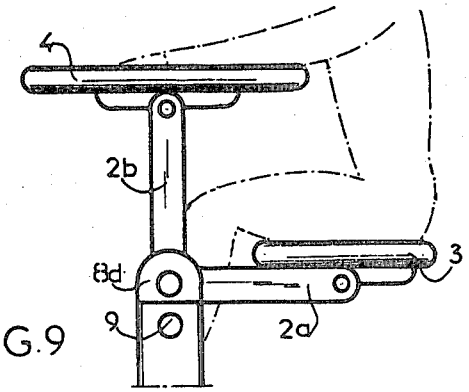

In FIG. 9, the work tops are placed horizontally. The large work top 4 is at a height of about 84 cm and serves as a horizontal or sloping work station whereas the small work top 3 is at a height of about 56 cm and is used as a seat. The cross bar 5 can be used as a foot rest by the user.

Figure 10:
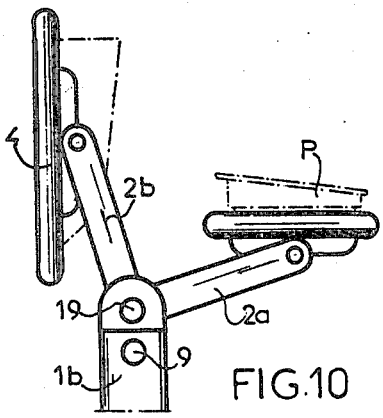

In FIG. 10, the small work top 3 is placed horizontally and may receive, for example, a key board P, whereas the large work top 4 is inverted and placed vertically to be equipped with one or several extra flat video screens. In this specific use as a data processing work station, the positions of the two work tops as described and illustrated may be reversed. A swivelling and directional lighting system may be added to complete this installation.

It is quite evident that, according to the invention, the work station may have three work tops, 3, 4 and 3*a*, which may be of equal width or not, (drawn in fine lines, FIG. 7). Each work top being, supported by a pivoting arm, independently, 2*a*, 2*b*, 2I which can be adjusted to the position or held in place in the support-yoke 8*d*, taking up a fixed angular position which is predetermined suitably.

No matter in what way the work station may be composed and formed, the pivoting arms may be be of unequal lengths and/or variable, in order to obtain specific working heights. In the same way, the supporting base of the legs may be symmetric with regard to the uprights. It should also be noted that the work tops may be in the form of supports in the shape of closed frames, allowing additional volumes to be assembled by imbrication and equipped to allow for hooking on of storage units.

According to another assembly, FIGS. 11, 12, 13, 14 and 15, the connecting and locking heads 21 relating to the same work top 3 or 4, are connected together in pairs to unlock the corresponding work top in order to be able to place it in the desired angular position. A system ensures the automatic return to the locking position.

To ensure this, each head 21 is made in the shape of a disc with projecting pins or centering pegs 21*a*, freely engaged in the additional holes T of the ends corresponding to the arms 2*a* or 2*b*, while still being able to operate in conjunction with the holes in each of the triangular supports S.

Each head is assembled with free sliding on the smooth bearing surface 20*a* of the pivoting axles 20, projecting from the inside of work tops. An elastic means such as a spring 22, is engaged on the bearing surface 20*a* to press on the head 21 and to be stopped at its other end by a ring wich is integral with the free end of the shaft 20.

Each head 21 operated by bearing against the ends of the arms 2*a* and 2*b*, shows centering pegs 21*a* which are engaged both in the thickness of the abovementioned arms and the triangular supports S, to immobilize the work tops 3 and 4 at an angle in the desired position. Moreover, according to their specific mounting as described above, the heads 21 can be placed in a straight line movement around the smooth bearing surface 20*a* of the shaft and following a sufficient length required to disengage the pegs 21*a* to unlock the ends of the arms 2*a* and 2*b* of the corresponding support S of the work top.

The heads 21 of the same work top are moreover connected in pairs by a system which can ensure their simultaneous travelling movement over a limited distance. For this reason, each head 21 is integral with a brace 24 connected by a turning bushing 25 to a bent rod 26 or 27 whose free end is connected to a control lever 28 which is operated by hand.

This lever 28 is articulated by means of a pivot axle 29, fixed under the work top 3 and 4 and shows a grip 28*a* to move it at an angle. A support plate 30 ensures guiding of the lever 28 which has a T profile cross section particularly.

Figure 3:
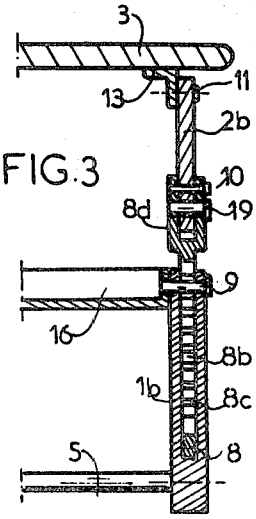
FIG. 3 is a partial view showing the cross section as on the line 3—3 on FIG. 2.

The ends of the rods 26 and 27 are connected to the lever 28, in a symmetrical way with regard to the pivot axis 29 which is situated at about the level of the longitudinal median axis of the work tops 3 and 4, i.e. in an axial straight line with the opposite locking heads 21 (FIG. 3).

The rods 26 and 27 are freely inserted in the thickness of the vertical wing 28*b* of the lever 28 whilst the nuts 31 and 32 or others ensure the connecting of the said lever with the rods. The opposite end of the rods 26 and 27 is bent at 26*a* and 27*a* to be connected in the corresponding bush 25. Profile section plates 33 and 34 fixed under the work top 3 or 4 in its centre part, ensure the guiding of the rods 26 and 27 respectively.

The effort applied on the lever 28 (dot and dash lines, FIG. 13) has the effect of controlling the opposite movements F1 and F2 of the connecting heads 21 in order to free the pegs 21 and to thus allow the pivoting at an angle of the work top 3 or 4 around the pivoting axes 20. The return springs 22 are compressed so that, when in the desired angular position of the work top, when the lever 28 is released, the heads 21 return automatically to the lock position.

It is stressed that the support plate 30 which ensures the guiding of lever 28 is placed in position under the work top 3 or 4 in such a way as to allow the angular movement of the abovementioned lever only in the suitable direction.

According to another assembly, we wished to improve the adjustment in height of the supports 8, in the hollow part of the vertical uprights 1*b* (FIGS. 12 and 13).

To do so, each support 8 is equipped with a rack 35 engaging with the pinions 36 and 37 mounted permanently at the end of a shaft 38 mounted with free rotation in the thickness of the vertical uprights 1*b*. This shaft 38 is designed to be able to be controlled in rotation by any known and suitable means. For example, a crank system M can enmesh with a conical pinion 39 which is in one with the shaft 38, so that, when operating the crank M in one direction or the other, the pinions 36 and 37 are driven in the same direction to adjust the height of the supports 8 with regard to the uprights 1*b* of the support legs.

I claim:

1. A transformable universal work station comprising:

support legs with support base and uprights;

four independent pivoting arms forming two pairs of pivoting elbows;

means for locking each said pair of arms to each other at a fixed angle at one end of each said arm;

means for mounting said elbows on said support legs;

two work tops; and means for mounting said work tops at the second ends of said arms, including means for independently setting and locking the angles of said work tops to said arms.

2. A work station according to claim 1 in which said uprights of said support legs are hollow in order to allow a sliding mounting of adjustable supports which can be adjusted in height and whose upper ends are formed so as to allow an adjustable angular positioning of said elbows whereby said upper ends of said adjustable supports form yokes in which said elbows are mounted.

3. A work station according to claim 2 in which said adjustable supports have a series of round openings which are used in cooperation with round openings in said uprights and a locking means through said openings in order to set the height of said adjustable supports.

4. A work station according to claim 2 in which said supports are provided with a rack which engages pinions mounted on a shaft whose ends are mounted in said uprights whereby the height of said supports can be adjusted.

5. A work station according to claim 1 where the peak of the angle formed by said first ends of said arms is pierced transversally so that said elbow can be pivoted in said yoke about an axle and where concentrically pierced positioning holes in said elbows and said yoke permit an engagement of a pegging means.

6. A work station according to claim 1 where said second ends of said arms are pierced through in order to permit the insertion of axles each of which engages an appropriate part of said work tops so that said work tops can be pivoted and locked in any desired angular position.

7. A work station according to claim 1 in which the upper parts of said uprights are connected by a service duct which functions as a cross-brace.

8. A work station according to claim 1 in which said work tops have triangular supports attached to said second ends of said arms with axles through concentric holes.

9. A work station according to claim 8 in which locking heads are connected together in pairs to unlock the corresponding work top and in which said locking heads automatically return to the locking position.

10. A work station according to claim 9 in which each said locking head has projecting pins engaging concentric holes in said arms and in said triangular supports.

11. A work station according to claim 10 in which each said locking head slides on the smooth bearing surface of the pivoting axle and in which a spring sliding on said smooth bearing surface presses said locking head away from a ring.

12. A work station according to claim 11 in which each said locking head is integral with a brace which is connected by a turning bushing to a rod whose free end is connected to a control lever which is operated by hand.

13. A work station according to claim 12 in which a pivot axle is fixed under said work top such that by pressing said control lever each said rod axially pulls said heads in opposite directions by means of said braces and in combination with a partial rotation of said turning bushings produces the release of said projecting pins for the angular adjusting of said work tops.

* * * * *